United States Patent [19]

Kitamura

[11] Patent Number: 4,919,363

[45] Date of Patent: Apr. 24, 1990

[54] BOBBIN HANGER

[76] Inventor: Yoji Kitamura, 1-18, Deguchi 1-chome, Hirakata-shi, Osaka-fu, Japan

[21] Appl. No.: 396,126

[22] Filed: Aug. 21, 1989

[51] Int. Cl.[5] ..... B65H 49/00; B65H 49/22

[52] U.S. Cl. ..... 242/130.2

[58] Field of Search ..... 242/130.2, 129.7

[56] References Cited

U.S. PATENT DOCUMENTS

| | | | |
|---|---|---|---|
| 3,265,322 | 8/1966 | Whitehead, Sr. et al. | 242/130.2 |
| 3,400,899 | 9/1968 | Tytgath | 242/130.2 |
| 3,512,731 | 5/1970 | Kitamura | 242/130.2 |
| 3,856,231 | 12/1974 | Whitehead, Sr. et al. | 242/130.2 |

FOREIGN PATENT DOCUMENTS

| | | | |
|---|---|---|---|
| 12256 | 2/1981 | Japan | 242/130.2 |

*Primary Examiner*—Stanley N. Gilreath

*Attorney, Agent, or Firm*—Oblon, Spivak, McClelland, Maier & Neustadt

[57] ABSTRACT

A bobbin hanger enabling the use of a mechanical bobbin changing apparatus. The bobbin hanger is constructed so as to provide an allowance for the movement of a weight for controlling a bobbin holding mechanism in the range of 4 to 10 mm so that the mechanical bobbin changing apparatus is able to achieve bobbin hanging and bobbin removing operations without fail. The bobbin hanger employs bobbin holding fingers formed in a shape which will not allow the bobbin holding fingers to be retracted easily into a bobbin hanging tube by a horizontal force acting on the bobbin holding fingers so that the accidental removal of the bobbin hung on the bobbin hanger is prevented.

7 Claims, 5 Drawing Sheets

BOBBIN HANGER

BACKGROUND ART

The present invention relates to a bobbin hanger for use in the textile industry and, more specifically, to a bobbin hanger for holding a yarn package or a roving package on a textile machine or for conveying a yarn package, a roving package or an empty bobbin.

Various bobbin hangers are used in the textile industry. Shown in FIG. 10 is a typical currently and widely used bobbin hanger capable of smooth rotation and slight swing. This bobbin hanger has a bobbin hanging tube 1 having an expanded section 1*a* having a larger diameter and a reduced section 1*b* having a smaller diameter, and joined to a tubular holding member 2. A bobbin B is fitted on the reduced section 1*b*. As shown in FIG. 11, longitudinal grooves 1*c* (only one of them is shown in FIG. 11) are formed diametrically in the reduced section 1*b*. An opening 1*d* is formed at the upper end of each groove 1*c* so as to connect with a longitudinal, bottomed square hole 1*e* formed coaxially in the central portion of tee reduced section 1*b*. Grooves 1*q* are formed, respectively, in the opposite surfaces of the square hole 1*e* so as to correspond to the grooves 1*c* respectively. Longitudinal slots 1*i* are formed diametrically at an angular distance of 90° from the grooves 1*c* in the lower end of the reduced section 1*b* so as to connect with the square hole 1*e* to receive retractable bobbin holding fingers 6 therein. A weight 3 having inner projections 3*a* is put on the reduced section 1*b* with the inner projections 3*a* received, respectively, in the grooves 1*c* for axial movement along the reduced section 1*b*. A pin 1*h* is fitted in a hole 1*p* penetrating the lower ends of the bottom walls of the grooves 1*c* so that the opposite ends thereof project into the grooves 1*c* to prevent the weight 3 from falling off the reduced section 1*b*. A sliding member 4 shown in FIG. 12 is fitted slidably in the square hole 1*e* of the reduced section 1*b*. The bobbin holding fingers 6 are joined pivotally to the lower end of the sliding member 4 with a pin 6*a*. A retaining member 5 is supported pivotally on the upper part of the sliding member 4 with a pin 5*d*. The retaining member 5 has a square ratchet 5*a* and a base block 5*b* formed integrally with the square ratchet 5*a*. Projections 5*c* are formed, respectively, on a pair of opposite sides of the base block 5*b*. Grooves 4*a* are formed diametrically in the upper end of the sliding member 4. Sliding member 4 is provided with flanges 4*b* in the upper portion thereof. The flanges 4*b* rest on the upper end 1*f* (FIG. 11) of the reduced section 1*b* to limit the downward movement of the sliding member 4. Splines 4*d* extending downward from the flanges 4*b* engage the grooves 1*q* formed in the square hole le and project through the openings 1*d* into the grooves 1*c* so as to engage the projections 3*a* of the weight 3, respectively. A ratchet operating member 7 is formed by bending a single spring strip and has an operating leg 7*a*, a head 7*b* and a stopping lug 7*c*. In assembling the bobbin hanger, the ratchet operating member 7 is put in the grooves 4*a* of the sliding member 4, the bobbin holding fingers 6 are retracted into the sliding member 4, the sliding member 4 is inserted in the square hole 1*e* of the bobbin hanging tube 1, a compression spring 8 is placed on the flanges 4*b*, a holding plate 9 is placed on top of the compression spring 8, and then a pin 2*a* is inserted in through holes 1*g* formed in the wall of the expanded section 1*a* of the bobbin hanging tube 1, through holes 2*b* formed in the wall of the holding member 2 and a through hole 9*a* formed in the holding plate 9 to join together the bobbin holding tube 1 and the holding member 2 as shown in FIG. 13. When the bobbin hanger is thus assembled, the stopping lug 7*c* of the ratchet operating member 7 rests on the upper end 1*f* of the reduced section 1*b*, and the head 7*b* of the ratchet operating member 7 is received in a recess 9*b* (FIG. 13) formed in the lower surface f the holding plate 9. When placed substantially in a horizontal position, the projections 5*c* of the base block 5*b* engage the upper end lf to retain the sliding member 4 at an upper position as shown in FIG. 13. In this state, the bobbin holding fingers 6 are retracted into the reduced section 1*b* of the bobbin hanging tube 1, and the weight 3 rests on the pin 1*h*.

In hanging a bobbin B on the bobbin hanger, the weight 3 is pushed up by the bobbin B, while the projections 3*a* of the weight 3 engage the lower ends of the splines 4*d* of the sliding member 4 projecting into the openings 1*d* to push up the sliding member 4 to an uppermost position against the resilience of the compression spring 8 as shown in FIG. 14. Consequently, the tooth of the ratchet 5*a* of the retaining member 5 engages the lower end of the operating leg 7*a* of the ratchet operating member 7, and thereby the retaining member 5 is turned through an angle of 90° and the projections 5*c* are placed in a vertical position as shown in FIG. 14 as the sliding member 4 is moved upward. Then, an upward force applied to the bobbin B is removed. Consequently, as shown in FIG. 15, the bobbin B drops together with the weight 3 to a hanging position, where the retaining member 5 is received in the square hole le, the flanges 4*b* of the sliding member 4 rest on the upper end 1*f* of the reduced section 1*b*, and the bobbin holding fingers 6 are caused to swing outward by the pin 1*h* and engage the stepped par $B_1$ of the bobbin B to hold the bobbin B on the bobbin hanger.

In removing the bobbin B from the bobbin hanger, the bobbin B is pushed up again to move the sliding member 4 to the uppermost position, whereby the retaining member 5 is turned through an angle of 90° and the bobbin holding fingers 6 are retracted into the bobbin hanging tube 1 to release the bobbin B.

In hanging the bobbin B on this conventional bobbin hanger, the bobbin B is put on the reduced section 1*b* of the bobbin hanging tube 1 and pushed up by hand together with the weight 3 to an uppermost position, where the upper end of the weight 3 is in abutment with the lower end 1*r* of the expanded section 1*a*. Thus, the bobbin hanger is designed so that the retaining member 5 pivotally supported on the sliding member 4 has been turned through an angle of 90° by the operating leg 7*a* of the ratchet operating member 7 before the bobbin B arrives at the uppermost position where the upper end of the weight 3 is in abutment with the lower end 1*r* of the expanded section 1*a*, and an allowance C, namely, the distance between the upper end of the weight 3 and the lower end 1*r* of the expanded section 1*a* at the completion of turning of the retaining member 5 through an angle of 90°, is very small. Thus, the bobbin B is pushed up to the uppermost position in hanging the bobbin B on and removing the same from the bobbin hanger by hand.

Recently, bobbin changing apparatus have been introduced into spinning mills for the mechanical bobbin changing operation on spinning frames and roving frames. The bobbin changing apparatus puts bobbins on bobbin hangers and removes the same from the bobbin hangers individually or simultaneously with arms 10 (FIG. 10). When such a mechanical bobbin changing apparatus is used for mechanically putting bobbins on and removing the same from bobbin hangers, it is difficult to position bobbins in alignment with the bobbin hanging tubes of the bobbin hangers unless the bobbin hangers are disposed very accurately. Furthermore, since the stroke of the arm of the mechanical bobbin changing apparatus is fixed, the bobbin hangers must be arranged on the same level, and it is difficult to achieve mechanical bobbin changing operation satisfactorily if the bobbin hangers are arranged on different levels or the bobbin hangers are supported on an easily bendable support.

Since the lower end 1*j* of the reduced section 1*b* of the bobbin hanging tube 1 is flat as shown in FIG. 13, sometimes, the bobbin hanging tube 1 fails to enter the bore of the bobbin B smoothly. Particularly, since the result of the mechanical bobbin changing operation is not confirmed by the operator, it is possible that the bobbin is not hung on or removed from the bobbin hanger successfully or the bobbin hanger is damaged by a faulty mechanical bobbin changing operation.

When a horizontal force acts in the direction of an arrow $F_1$ on the bobbin holding finger 6 engaging the inner stepped part $B_1$ of the bobbin B, FIG. 15, to cause the bobbin holding finger 6 to be moved in the direction of an arrow $M_1$ by the pin 1*h* engaging the inclined surface 69 of the bobbin holding finger 6 and the bobbin B falls off the bobbin hanger, which is possible to occur when the bobbin conveying apparatus is braked abruptly or started suddenly, because the downward pressure applied to the sliding member 4 by the compression spring 8 is small to facilitate bobbin hanging operation and bobbin removing operation, and the inclined surface 69 of the bobbin holding finger 6 is liable to slide upward along the pin 1*h*.

DISCLOSURE OF THE INVENTION

Accordingly, it is an object of the present invention to provide a bobbin hanger capable of surely functioning in combination with a mechanical bobbin changing apparatus, which moves a bobbin through a fixed distance in hanging the bobbin on and removing the bobbin from the bobbin hanger, regardless of slight deviation or variation of the position thereof from a predetermined position relative to the mechanical bobbin changing apparatus, and retractable bobbin holding fingers capable of reliable operation.

It is another object of the present invention to provide a bobbin hanger having a bobbin hanging tube capable of surely entering the bore of a bobbin even if the axis of the bobbin hanger and that of the bobbin are dislocated relative to each other.

It is a further object of the present invention to provide a bobbin hanger having bobbin holding fingers which are not readily retracted to release the bobbin hung on the bobbin hanger even if a horizontal force acts thereon when the bobbin hanger conveying apparatus is braked abruptly or started suddenly.

DETAILED DESCRIPTION OF THE INVENTION

Representative embodiments of the present invention will be described hereinafter with reference to the accompanying drawings.

Figure 1:
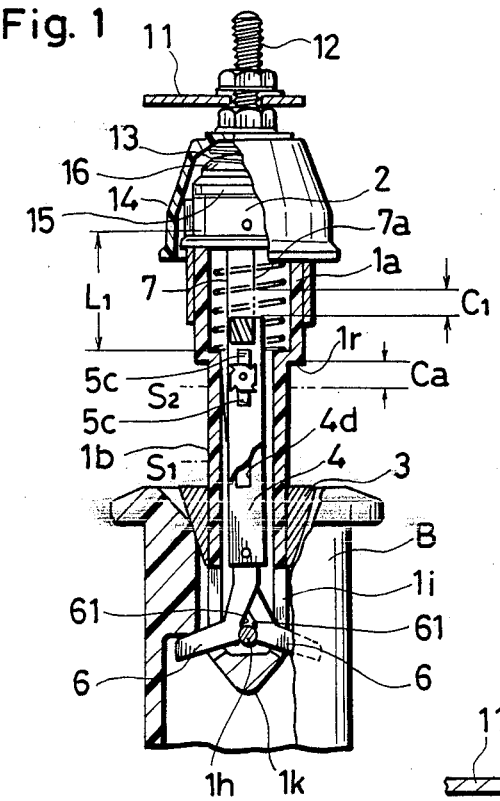
FIG. 1 is a partially cutaway side elevation of a bobbin hanger in a first embodiment according to the present invention, in which the parts are shown in positions for hanging a bobbin.

Referring to FIG. 1, showing a bobbin hanger in a first embodiment according to the present invention, a holding member 2 has a spherical upper wall 15 having a central hole and is provided internally with a spherical seat. A bolt 12 is passed through the center hole of the upper wall 15, a dust cover 16 having a shape conforming to the outer surface of the upper wall 15 and placed on the upper wall 15, a brake spring 13 placed on the dust cover 16, and a cap 14 placed on the brake spring 13, and a nut is screwed on the bolt 12 to fasten together the holding member 2, the dust cover 16, the brake spring 13 and the cap 14. A ball bearing is mounted on the bolt 12 between the head of the bolt 12 and the spherical seat formed in the upper wall 15 to allow the holding member 2 to move for rotation and slight swing motion on the bolt 12. The bolt 12 is fastened to a support member 11 for supporting the bobbin hanger.

Figure 13:
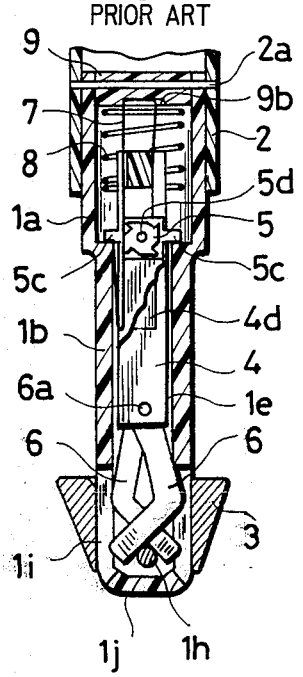
Fig. 13 PRIOR ART
FIGS. 13, 14 and 15 are fragmentary longitudinal sectional views illustrating the successive positions of the bobbin hanger of FIG. 10 during a bobbin hanging operation.
Figure 14:
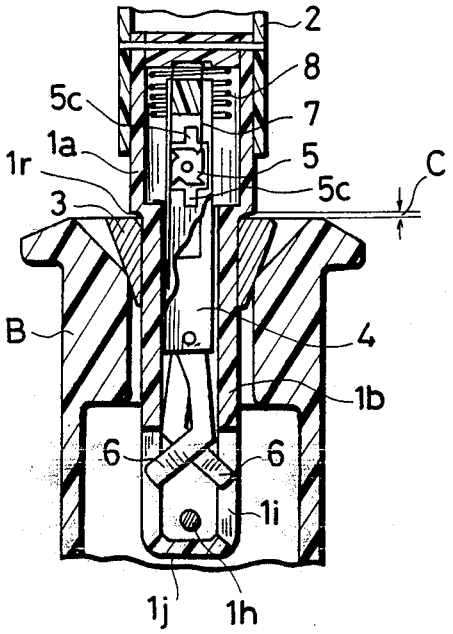
Fig. 14 PRIOR ART
Figure 15:
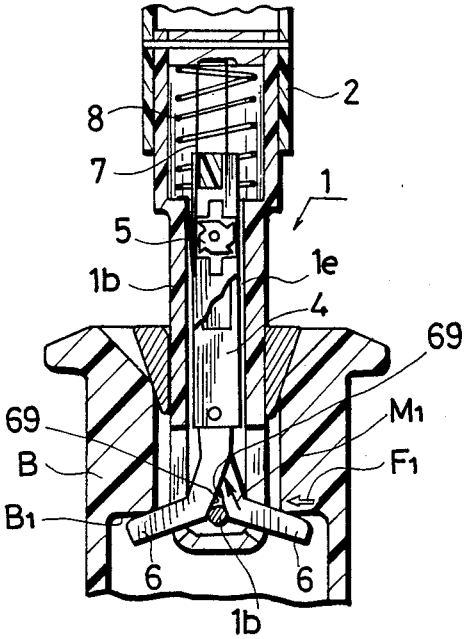
Fig. 15 PRIOR ART

A bobbin hanging tube 1 has an expanded section 1*a* and a reduced section 1*b*. The length of the expanded section 1*a* is greater than that of the expanded section of the bobbin hanging tube of the conventional bobbin hanger shown in FIGS. 13, 14 and 15. The length of the operating leg 7*a* of a ratchet operating member 7 is longer by a length $C_1$ than the operating leg of the ratchet operating member of the conventional bobbin hanger shown in FIGS. 13, 14 and 15. When a bobbin B is applied to the lower end of the bobbin hanging tube 1 and moved upward by a bobbin changing apparatus to hang the bobbin on the bobbin hanger, a weight 3 engages the splines 4*d* of a sliding member 4 at a position $S_1$. When the weight 3 is pushed up further together with the sliding member 4 to a position $S_2$, a retaining member 5 pivotally supported on the sliding member 4 is turned substantially through and angle of 90° by the operating leg 7*a* of the ratchet operating member 7, so that the projections 5*c* of the retaining member 5 are placed in a vertical position as shown in FIG. 1. In this state, a gap Ca, namely, an allowance for the upward movement of the weight 3, is secured between the upper end of the weight 3 and the shoulder 1*r* of the expanded section 1*a* of the bobbin hanging tube 1. Accordingly, the weight 3 never collides against the shoulder 1*r* even if the bobbin B is pushed up excessively. The size of the gap Ca is determined taking into consideration errors in the height of the bobbin hanger and in the stroke of the bobbin pushing mechanism of the bobbin changing apparatus. Generally, the size of the gap Ca is in the range of 4 to 10 mm.

Figure 2:
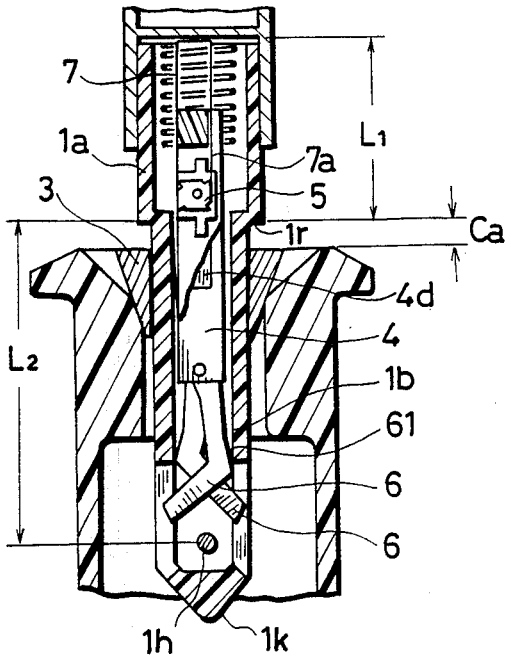
FIG. 2 is a partially cutaway side elevation of a bobbin hanger in a second embodiment according to the present invention, in which the parts are shown in positions during a bobbin hanging operation.

As shown in FIG. 2, both the expanded section 1*a* and reduced section 1*b* of the bobbin hanging tube 1 may be formed, respectively, in lengths $L_1$ and $L_2$ greater than those of the expanded section and reduced section of the bobbin hanging tube of the conventional bobbin hanger, and the length of the operating leg 7*a* of the ratchet operating member 7 may be increased accordingly to secure the gap Ca of a size in the range of 4 to 10 mm.

Figure 3:
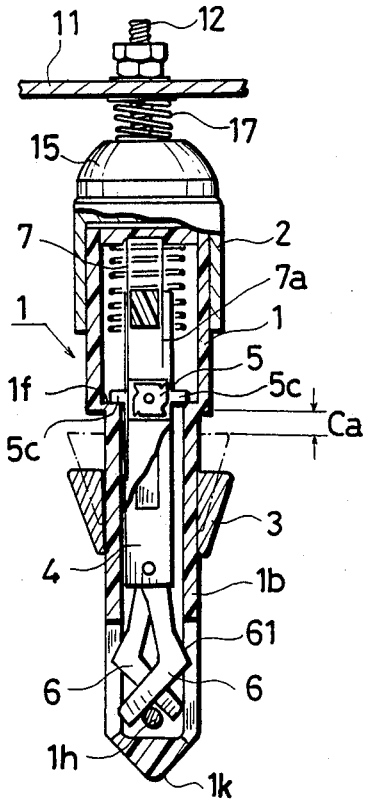
FIG. 3 is a partially cutaway side elevation of a bobbin hanger in a third embodiment according to the present invention.

As shown in FIG. 3, the position where the sliding member 4 is retained may be lowered within a range in which the bobbin holding fingers 6 are held in a retracted position, by lowering only the upper end 1*f* of the reduced section 1*b* of the bobbin hanging tube 1 on which the projections 5*c* of the retaining member 5 rest and extending the operating leg 7*a* of the ratchet operating member 7. When the bobbin hanger is thus constructed, the length of the opening 1*d* formed in the reduced section is increased.

The bobbin hanger of the present invention may be a swingable bobbin hanger as those shown in FIGS. 1 and 2 or a bobbin hanger mainly for conveying a bobbin as shown in FIG. 3. The bobbin hanger shown in FIG. 3 is attached to a support member 11 with a compression spring 17 between the holding tube 2 thereof and the support member 1, and the holding tube 2 is unable to rotate and capable of automatic alignment. Since the bobbin hanger shown in FIG. 3 is unable to swing, the lower end 1*k* of the reduced section 1*b* of the bobbin hanging tube 1 is tapered to facilitate inserting the bobbin hanging tube 1 into the bore of a bobbin B. The holding tube 2 may be directly and fixedly attached to the support member 11. In such a case, the bobbin B is hung on the bobbin hanger in an inclined position and is handled in the inclined position for mechanical bobbin changing operation.

Figure 4:
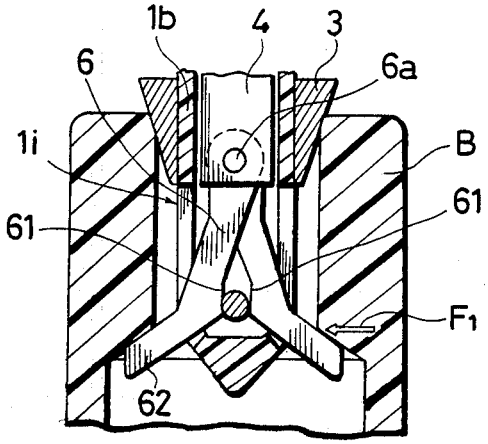
FIG. 4 is an enlarged fragmentary longitudinal sectional view of a bobbin hanger in a fourth embodiment according to the present invention.
Figure 5:
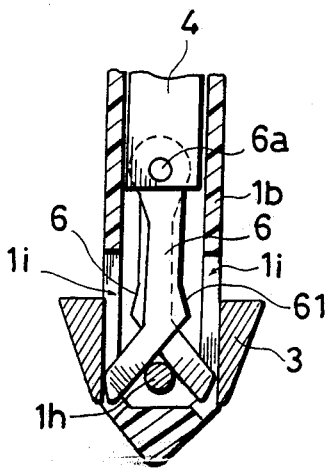
FIG. 5 is a fragmentary longitudinal sectional view showing the bobbin holding fingers of the bobbin hanger of FIG. 4 in a retracted position.

FIG. 4 shows bobbin holding fingers 6 embodying the present invention. When the bobbin holding fingers 6 are caused to swing outward by a pin 1*h*, portions 61 of the bobbin holding fingers 6 in contact with the pin 1*h* extend vertically. Accordingly, the portions 61 do not slide along the pin 1*h* and hence the bobbin holding fingers 6 are not pushed upward even if a horizontal force $F_1$ acts on the bobbin holding fingers 6. When a sliding member 4 pivotally supporting the bobbin fingers 6 is moved upward, the portions 61 are separated from the pin 1*h* and the bobbin holding fingers 6 are retracted by gravity into the reduced section 1*b* of a bobbin hanging tube 1 as shown in FIG. 5.

Figure 6:
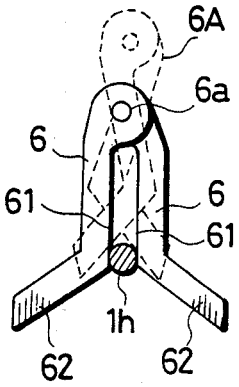
FIG. 6 is a diagrammatic illustration of bobbin holding fingers incorporated into a bobbin hanger in a fifth embodiment according to the present invention.

FIG. 6 shows a modification of the bobbin holding finger 6 shown in FIG. 4. Bobbin holding fingers 6 shown in FIG. 6, similarly to those shown in FIG. 4, have portions 61 which extend vertically when the bobbin holding fingers 6 are projected fully from the reduced section 1*b* by the pin 1*h*. The portions 61 of the bobbin holding fingers 6 shown in FIG. 6 is longer than those of the bobbin holding fingers shown in FIG. 4. The bobbin holding fingers 6 shown in FIG. 6 can be surely retracted by gravity as indicated by broken lines 6A in FIG. 6.

Figure 7:
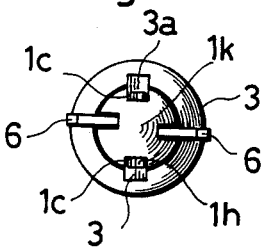
FIG. 7 is a bottom view of the bobbin hanger of FIG. 2.
Figure 8:
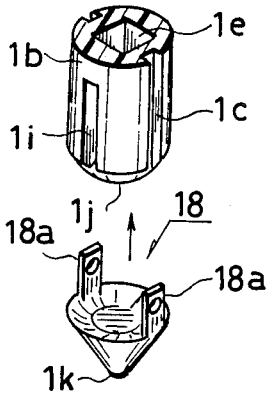
FIG. 8 is an exploded perspective view of a portion of a bobbin hanger in a sixth embodiment according to the present invention.
Figure 9:
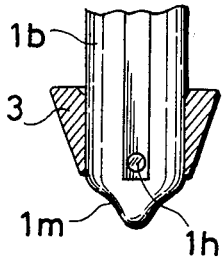
FIG. 9 is a fragmentary longitudinal sectional view of assistance in explaining a bobbin hanger in a seventh embodiment according to the present invention.
Figure 10:
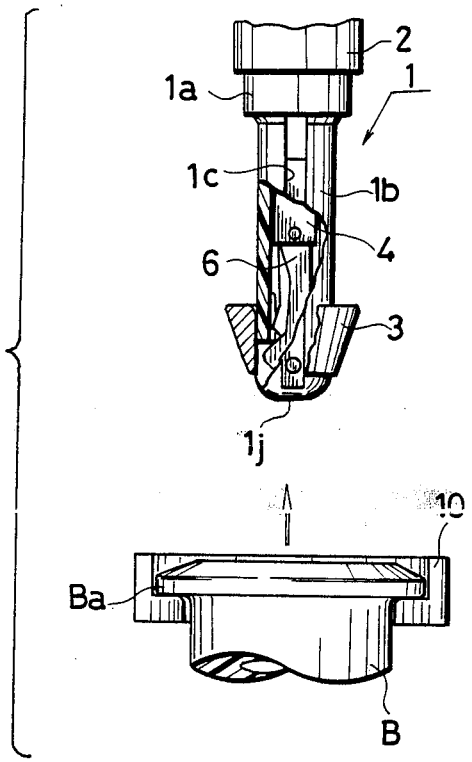
Fig. 10 PRIOR ART
FIG. 10 is a partially cutaway side elevation of a conventional bobbin hanger, in which the parts are shown in positions for hanging a bobbin.
Figure 11:
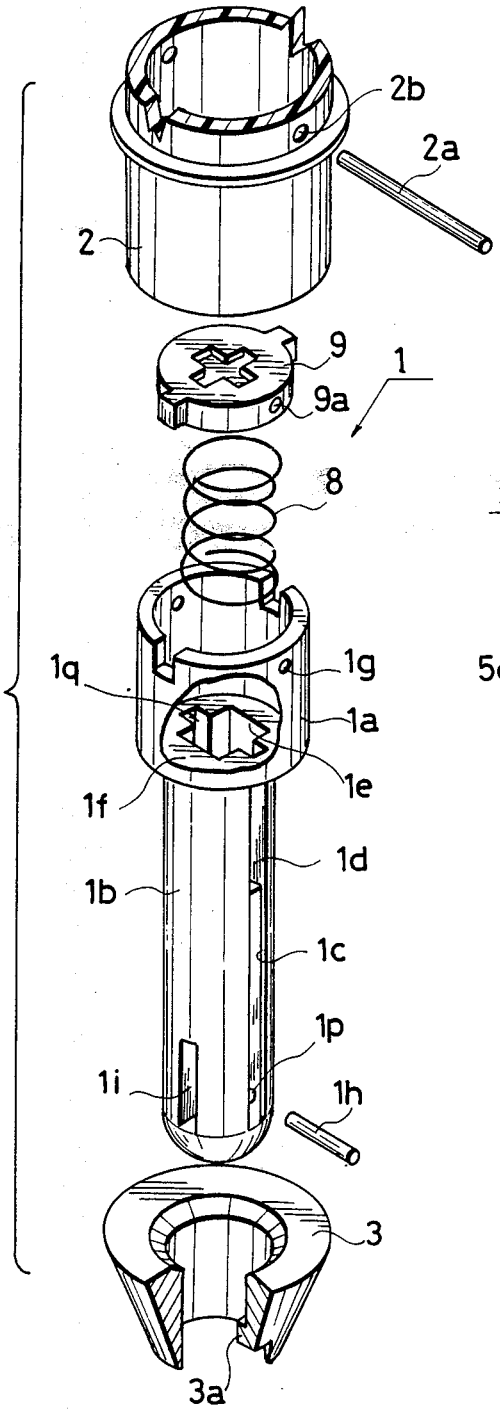
Fig. 11 PRIOR ART
FIG. 11 is an exploded perspective view of the bobbin hanging tube assembly of the bobbin hanger of FIG. 10.
Figure 12:
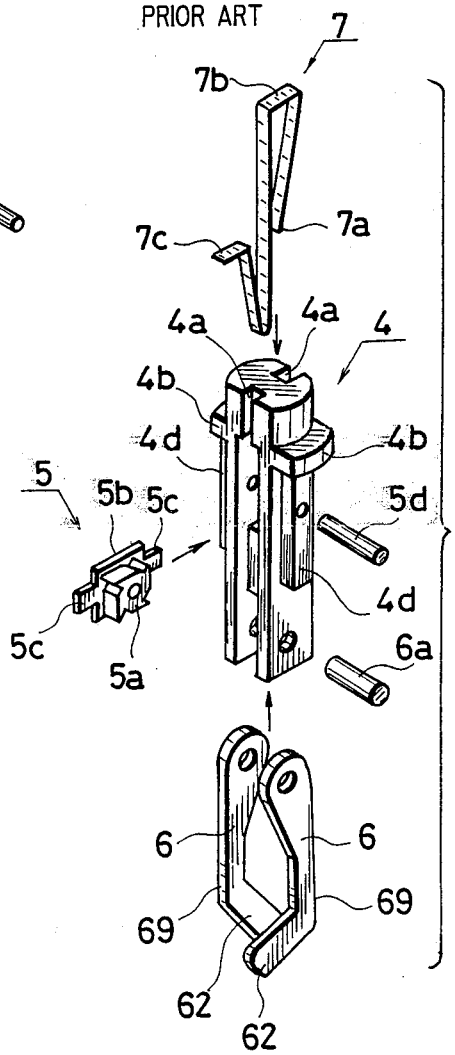
Fig. 12 PRIOR ART
FIG. 12 is an exploded perspective view showing the component parts of the bobbin hanger of FIG. 10.

FIG. 7 is a bottom view of the bobbin hanging tube 1 of the bobbin hanger shown in FIG. 1. The lower end 1*k* of the bobbin hanging tube 1 is tapered to facilitate the insertion of the bobbin hanging tube 1 into the bore of a bobbin B. The lower end 1*k* may be formed in a substantially tapered shape having a portion formed of a concave surface 1*m* as shown in FIG. 9. The tapered lower end may be a separate tapered tip member 18 as shown in FIG. 8. The tapered tip member 18 may be attached adhesively to the lower end 1*j* of the reduced section 1*b* or the tapered tip member 18 may be provided with lugs 18*a* as shown in FIG. 8; the lugs 18*a* are fitted in grooves 1*c* formed in the lower end of the reduced section 1*b* and joined to the reduced section 1*b* with the pin 1*h*.

The lower end 1*k* of an acute angle facilitate the insertion of the bobbin hanging tube 1 into the bore of a bobbin B.

The bobbin hangers thus constructed in accordance with the present invention ensure successful mechanical bobbin changing operation regardless of slight variations in the horizontal and vertical positions between the bobbin hangers or regardless of variation in the height of the bobbin support member. Furthermore, the bobbin hangers of the present invention hold bobbins securely even if a horizontal force acts on bobbins hung on the bobbin hangers.

What is claimed is:

1. A bobbin hanger comprising:

a bobbin hanging tube having an upper expanded section and a lower reduced section extending from the expanded section;

a sliding member pivotally supporting a pair of bobbin holding fingers at a lower position thereof, pivotally supporting a retaining member integrally provided with a ratchet and retaining projections at an upper position thereof, and axially slidably inserted in the reduced section of the bobbin hanging tube;

a ratchet operating member having an operating leg for operating the ratchet of the retaining member; and a weight axially slidably put on the reduced section of the bobbin hanging tube, said weight being capable of being pushed up by a bobbin to push up the sliding member so that the retaining member is turned substantially through an angle of 90° by the operating leg of the ratchet operating member engaging the ratchet of the retaining member to bring the retaining projections to a position for resting on the inner upper end of the reduced section of the bobbin hanging tube to retain the sliding member at a position where the bobbin holding fingers are allowed to swing outward to engage the inner surface of the bobbin;

characterized in that the position of the upper end of the weight at the completion of turning of the retaining member is 4 to 10 mm below the lower end of the expanded section of the bobbin hanging tube, and the bobbin holding fingers have a shape capable of preventing the retraction of the bobbin holding fingers into the interior of the bobbin hanging tube when acted upon by a horizontal force.

2. A bobbin hanger according to claim 1, the expanded section of said bobbin hanging tube is formed in a comparatively large length and the operating leg of said ratchet operating member is extended so as to locate the lower end of the operating leg at a comparatively low position to complete the turning of said retaining member when the upper end of said weight reaches a position 4 to 10 mm below the lower end of the expanded section of said bobbin hanging tube.

3. A bobbin hanger according to claim 1, wherein both the expanded section and reduced section of said bobbin hanging tube are formed, respectively, in comparatively large lengths and said ratchet operating member is formed in a comparatively large length to complete the turning of said retaining member when the upper end of said weight reaches a position 4 to 10 mm below the lower end of the expanded section of said bobbin hanging tube.

4. A bobbin hanger according to claim 1, wherein the inner upper end of the reduced section of said bobbin hanging tube on which the retaining projections rest is lowered and the operating leg of said ratchet operating member is extended so as to locate the lower end of the operating leg at a comparatively low position to complete the turning of said retaining member when the upper end of said weight reaches a position 4 to 10 mm below the lower end of the expanded section of said bobbin hanging tube.

5. A bobbin hanger according to claim 1, wherein respective portions of said bobbin holding fingers to come into contact with a pin for swinging said bobbin holding fingers extend vertically when said bobbin holding fingers are caused to swing, respectively, to bobbin holding positions.

6. A bobbin hanger according to claim 1, wherein the lower end of said bobbin hanging tube is formed in a tapered shape having an acute tip angle.

7. A bobbin hanger according to claim 6, wherein the tapered end of said bobbin hanging tube is formed of a separate tip member attached to said bobbin hanging tube with a pin.

* * * * *